US005626295A

United States Patent [19]

Heyse et al.

[11] Patent Number: 5,626,295

[45] Date of Patent: May 6, 1997

[54] INJECTION VALVE

[75] Inventors: Joerg Heyse, Markgroeningen; Norbert Belzner, Heilbidun, both of Germany

[73] Assignee: Robert Bosch GmbH, Stuttgart, Germany

[21] Appl. No.: 415,272

[22] Filed: Apr. 3, 1995

[30] Foreign Application Priority Data

Apr. 2, 1994 [DE] Germany ..... 44 11 554.7

[51] Int. Cl.[6] ..... B05B 1/00

[52] U.S. Cl. ..... 239/596; 29/890.142

[58] Field of Search ..... 239/601; 5/585.1–585.5, 5/590–590.5, 533.3–533.12, 596; 29/890.142, 890.143

[56] References Cited

U.S. PATENT DOCUMENTS

| | | | |
|---|---|---|---|
| 4,437,103 | 3/1984 | Ikeda | 239/601 X |
| 4,699,323 | 10/1987 | Rush et al. | 239/585.4 X |
| 4,819,871 | 4/1989 | Kronberger et al. | 239/533.3 |
| 4,923,169 | 5/1990 | Grieb et al. | 239/585.1 X |
| 4,934,653 | 6/1990 | Grieb et al. | 239/585.1 X |
| 5,052,624 | 10/1991 | Boers et al. | 239/525 |
| 5,092,039 | 3/1992 | Gaskell | 239/533.12 X |
| 5,263,648 | 11/1993 | Vogt et al. . | |
| 5,350,119 | 9/1994 | Bergstrom | 239/601 X |

FOREIGN PATENT DOCUMENTS

4026721A1 2/1992 Germany .

*Primary Examiner*—Kevin Weldon
*Attorney, Agent, or Firm*—Kenyon & Kenyon

[57] ABSTRACT

In an injection valve, a perforated disk made from a material of relatively great hardness. The perforated disk has a tensile strength of >800N/mm$^2$. Spray holes are punched from a downstream side of the perforated disk to an upstream side. A stamping break-out, which occurs due to the greater brittleness of the material, has no negative effects since the perforated disk is installed in the injection valve such that the direction of flow of the medium is exactly opposite to the punching direction. The injection valve is particularly suitable for fuel injection systems of mixture-compressing applied ignition internal combustion engines.

6 Claims, 2 Drawing Sheets

INJECTION VALVE

BACKGROUND OF THE INVENTION

The present invention relates to an injection valve including a perforated disk having a first surface, a second surface, and at least one spray hole, the spray hole being punched in a direction from the first surface to the second surface.

German Published Patent Application No. 40 26 721 ("the '721 application") discusses an injection valve which has a perforated disk downstream of its valve seat surface. The perforated disk of the '721 application has a plurality of spray holes, through which a medium such as fuel can pass. The spray holes in the perforated disk are made by erosion.

Using perforated disks, with spray holes made by punching, on injection valves is known. For example, cup-shaped perforated disks are made from a thin sheet and have a tensile strength of 400 to 600N/mm$^2$, depending on the material. When the spray holes are punched into the perforated disk, a punching draw-in is formed at the edge of the spray hole in a first surface (i.e., the surface of the perforated disk struck by the punch), and a protrusion, in the form of a burr, is formed at the edge of the hole in a second surface (i.e., the surface of perforated disk from which the punch emerges). Unfortunately, if the number of punching operations is large, it is impossible to keep these disadvantageous burrs constant and, as a result, relatively large scatter may occur in the flow and in the spray angle. In mass production, minimizing this scatter is desired. To minimize this disadvantageous scatter, the punching burrs can be ground off. However, the grinding process increases the cost of manufacturing the perforated disk. Accordingly, a process for producing perforated disks without burred holes, which does not require a separate grinding step, is needed.

SUMMARY OF THE INVENTION

The injection valve of the present invention includes a perforated disk having a tensile strength greater than 800N/mm$^2$ and which is installed in the injection valve such that its first surface (i.e., the surface struck by the punch) is downstream from its second surface (i.e., the surface from which the punch emerges). The perforated disks of the present invention are advantageously produced economically and simply and have punched spray holes which are free of a disadvantageous burr. Consequently, the scatter in the spray angle and in the flow rate is markedly reduced. Moreover, an involved deburring process is automatically eliminated. In mass production, the quality of the spray holes can be kept substantially constant thereby reducing the scatter in the medium flowing through the spray holes.

BRIEF DESCRIPTION OF THE DRAWINGS

Exemplary embodiments of the invention are depicted in simplified form in the drawing and explained in greater detail in tho description which follows.

DETAILED DESCRIPTION

Figure 1:
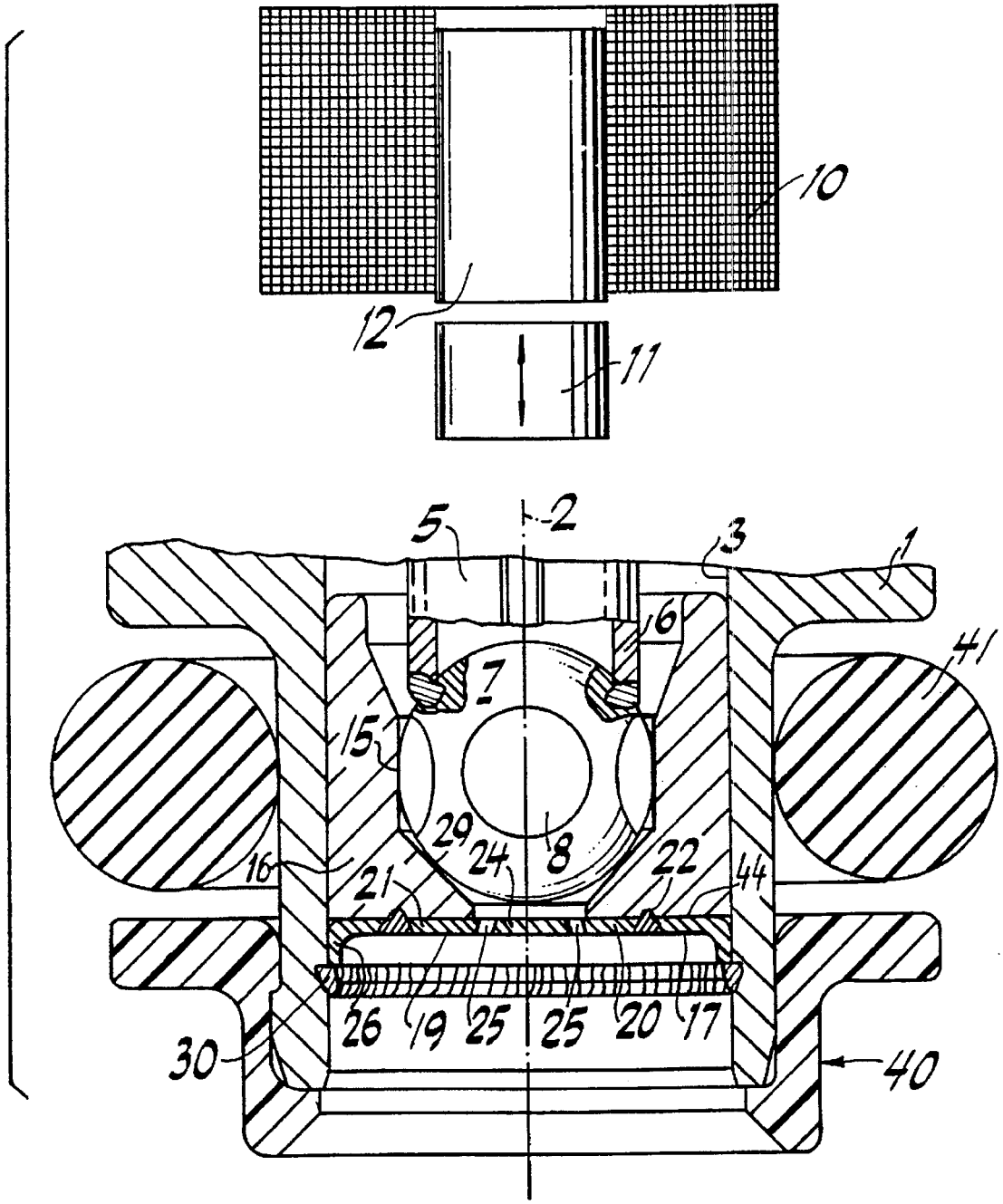
FIG. 1 illustrates a partial view of an injection valve.

FIG. 1 shows a partial view, as an exemplary embodiment, of an injection valve for fuel injection systems of mixture-compressing, applied-ignition, internal combustion engines. The injection valve has a tubular valve seat carrier 1 in which a longitudinal opening 3 is formed concentrically with respect to a valve longitudinal axis 2. A valve needle 5 is arranged in the longitudinal opening 3 and is, for example, tubular. The downstream end 6 of the valve needle 5 is connected to, for example, a spherical valve-closing body 7. Five flats 8, for example, are arranged on the circumference of the spherical valve closing body 7.

The injection valve is actuated in a known manner, for example electromagnetically. An indicated electromagnetic circuit with a magnet coil 10, an armature 11 and a core 12 is used for axially moving the valve needle 5, and hence for opening, counter to the spring force of a return spring (not shown), and closing the injection valve. The armature 11 is connected to the end of the valve needle 5 remote from the valve-closing body 7 by a laser weld, for example, and is aligned with the core 12.

A guide opening 15 in a valve seat body 16 is used to guide the valve-closing body 7 during the axial movement. The cylindrical valve seat body 16 is mounted leak-tightly, by welding, in the downstream end of the valve seat carrier 1 (i.e., the end of the valve seat carrier 1 remote from the core 11), in the longitudinal opening 3 extending concentrically with respect to the valve longitudinal axis 2. The bottom (or downstream) end 17 of the valve seat body 16 (i.e., the end of the valve seat body 16 which is opposite the valve-closing body 7), is concentrically and rigidly connected to a bottom part 20 of a perforated disk 21 of, for example, cup-shaped design. Thus, the upper (or upstream) end face 44 of the bottom part 20 rests against the bottom (or downstream) end 17 of the valve seat body 16.

The valve seat body 16 and the perforated disk 21 are connected by, for example, an encircling and leak-tight first weld 22 formed by means of a laser. This method of assembly eliminates the risk of unwanted deformation of the bottom part, 20 in its central area 24, which includes at least one, and, for example four, spray holes 25 formed by punching.

Adjoining the bottom part 20 of the cup-shaped perforated disk 21 is an encircling retaining rim 26. The retaining rim 26 exerts a radial spring action (i.e., a friction fit) on the wall of the longitudinal opening 3. In this way, as the valve-seat part, consisting of the valve seat body 16 and the perforated disk 21, is pushed into the longitudinal opening 3 in the valve seat carrier 1, shavings are not formed on the valve seat part or on the longitudinal opening 3. The retaining rim 26 of the perforated disk 21 is connected to the wall of the longitudinal opening 3 by, for example, an encircling and leak-tight second weld 30.

The depth of insertion of the valve-seat part, including the valve seat body 16 and the cup-shaped perforated disk 21, into the longitudinal opening 3 determines the presetting of the stroke of the valve needle 5 because one end position of the valve needle 5, when the magnet coil 10 is unexcited, is defined by the abutment of the valve-closing body 7 on a valve seat surface 29 of the valve seat body 16. The other end position of the valve needle 5, when the magnet coil 10 is excited, is defined by the abutment of the armature 11 on the core 12, for example. The distance between these two end positions of the valve needle 5 thus represents the stroke of the valve needle.

The spherical valve-closing body 7 interacts with the valve seat surface 29 of the valve seat body 16. The valve seat surface 19 tapers frustoconically in the direction of flow and is located, axially between the guide opening 15 and the bottom end 17 of; the valve seat body 16.

A protective cap 40 is arranged on the circumference of the valve seat carrier 1 at its downstream end (i.e., the end remote from the magnet coil 10) and is connected to the valve seat carrier 1 by means of snap-fastening, for example. A sealing ring 41 provides a seal between the circumference of the injection valve and a valve receptacle (not shown) in, for example, the intake line of the internal combustion engine.

Figure 2:
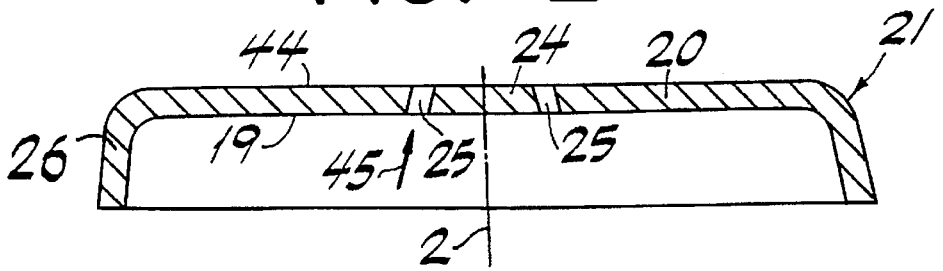
FIG. 2 illustrates a cross-section of a perforated disk used in the injection valve of the present invention.

FIG. 2 shows the cup-shaped perforated disk 21 with its spray holes 25 arranged in the central area 24. The spray holes 25, of which there are, for example, four, are distributed, symmetrically for example, around the valve longitudinal axis 2 in the form of corners of a square. Thus, the spray holes 25 are each equidistant from one another and from the valve longitudinal axis 2. The bottom part 20 of the perforated disk 21 has the upper (or upstream) end face 44,, which corresponds to a second flat surface, and an opposite, lower (or downstream) end face 19, which corresponds to a first flat surface.

Figure 3:
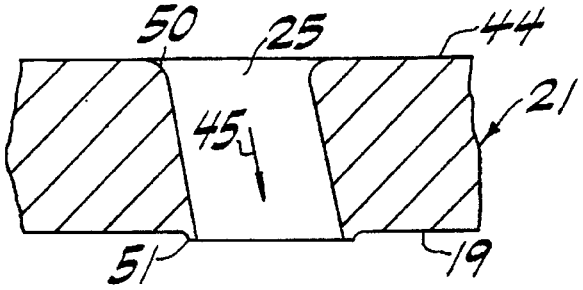
FIG. 3 is a cross-section of a conventional perforated disk of low hardness with a spray hole.

As illustrated in FIG. 3, in the past, the spray holes 25 of the perforated disk 21 were punched in the direction which would be the direction of flow of the medium. Thus, in the past, the punching operation in the perforated disks 21 was performed from the second surface 44 to the first surface 19, the first surface 19 lying downstream of the second surface 44 after installation.

In contrast, the spray holes 25 in the injection valve according to the present invention are punched in the opposite direction. The punching direction is indicated by an arrow 45. The punches of the punching tool thus first strike the first surface 19 of the bottom part 20 of the perforated disk 21, which lies-downstream of the second surface 44 in the subsequent installed position of the perforated disk 21 in the injection valve. The punched spray holes 25 penetrate the material of the perforated disk 21 as far as the second surface 44, where they emerge from the material. The punching direction is thus opposite to the direction of flow of the medium (FIG. 2).

FIG. 3 illustrates a spray hole 25 in a perforated disk 21 as formed with customary punching. Depending on the material, the known perforated disks have a tensile strength of 400 to 600N/mm$^2$. The relatively low hardness of the perforated disk, evidenced by these values, is the reason why a punching draw-in 50 (i.e. a cross-sectional enlargement of the spray hole 25) occurs in the second surface 44 due to the entry of the punch, while a burr 51, which protrudes from the surface 19, is formed on the first surface 19. The punching draw-in 50 and the burr 51, which are not shown to scale, on the spray hole 25 cause a comparatively large scatter in the flow and in the spray angle.

Figure 4:
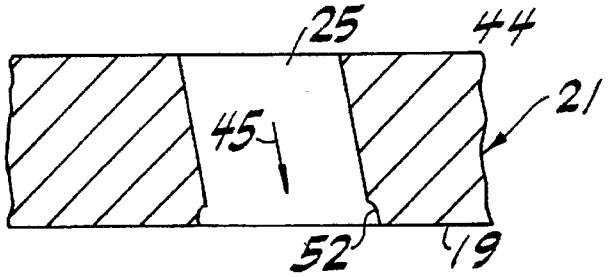
FIG. 4 illustrates a cross-section of a perforated disk of greater hardness with a spray hole.

In comparison, FIG. 4 illustrates a spray hole 25 in the perforated disk 21, which is manufactured from a material of greater hardness than the material of the perforated disk 21 illustrated in FIG. 3. The perforated disk 21 now has a tensile strength of >800 N/mm$^2$, which corresponds approximately to a Vickers hardness of >300 EV1. The hardness of the material of the conventional perforated disks 21 can be raised by cold working, for example. The greater hardness of the material reduces or eliminates the punching draw-in or burrs such that, if any punching draw-in or burrs arise, they are negligibly small. Since the material has a greater brittleness, no burrs are formed. Instead, a punching breakout 52 arises at the spray hole 25. More specifically, the material breaks at the surface where the punch emerges (i.e., at the first surface 19). This punching break-out 52 enlarges somewhat the cross section of the spray hole 25, only in the vicinity of the first surface 19. Although this means can reduce the scatter in the flow rates, the scatter in the spray angle remains because the punching break-out 52 is the first, downstream surface 19.

Figure 5:
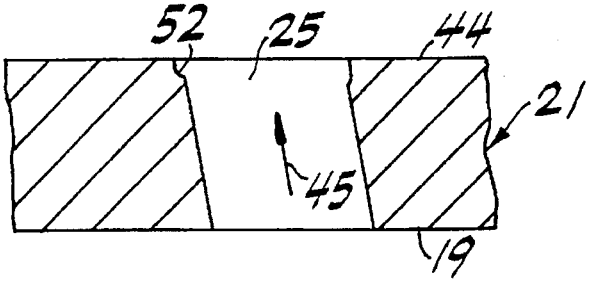
FIG. 5 illustrates a cross-section of a perforated disk of greater hardness having a spray hole which is punched in a direction counter to the subsequent direction of flow.

In accordance with the present invention, FIG. 5 shows a partial view of a perforated disk 21 with a spray hole 25 which has been punched in a direction opposite to the subsequent direction of flow of the medium, namely from the first surface 19 to the second surface 44, as indicated by the arrow 45 for the punching direction. The properties of the material is the same as in the perforated disk 21 shown in FIG. 4, the tensile strength of the material thus likewise being >800N/mm$^2$. In this case, the punching break-out 52, caused by punching, is situated at the second, upstream surface 44 of the perforated disk 21 which faces the valve-closing body 7 after installation in the injection valve. At the first, downstream surface 19, at which the medium, here for example fuel, emerges directly from the spray hole 25, there is a good-quality spray area which suffers virtually no negative effects from the punching. The transition from the spray hole 25 to the first surface 19 is thus relatively sharp-edged and therefore has virtually no deformations to cause negative effects during spraying. The scatter of the spray angle, in particular, remains advantageously very low due to this arrangement. The scatter in the: flow rate can be even further reduced by varying the punch diameters of the punching tool.

The configuration according to the present invention of the perforated disk 21 is possible with any form of perforated disk, even, for instance, with perforated disks which do not have a retaining rim 26 (i.e., which are not cup shaped).

What is claimed is:

1. In an injection valve having an upstream direction and a downstream direction, a perforated disk comprising:

(a) a first surface;

(b) a second surface arranged upstream of the first surface; and (c) at least one spray hole, the at least one spray hole being produced by punching from the first surface to the second surface, wherein the perforated disk has a tensile strength of at least 800N/mm$^2$.

2. The perforated disk of claim 1 wherein the perforated disk has a Vickers hardness of at least 300 HVI.

3. A method for producing a perforated disk for use in an injection valve, the method comprising steps of:

(a) providing a disk having a tensile strength of at least 800N/mm$^2$, and having an upstream surface and a downstream surface; and (b) punching, from the downstream surface to the upstream surface, at least one spray hole into the disk.

4. The method of claim 3 wherein the step of providing a disk having a tensile strength of at least 800N/mm$^2$includes sub-steps of:

providing a disk having a tensile strength of less than 800N/mm$^2$; and cold-working the disk so as to increase the tensile strength of the disk to at least 800N/mm$^2$.

5. The method of claim 4 wherein the disk having a tensile strength of less than 800N/mm$^2$ has a tensile strength of 400 to 600N/mm$^2$.

6. The method of claim 3 wherein the step of punching produces a punching break-out in the upstream surface.

* * * * *